United States Patent [19]

Ferton et al.

[11] Patent Number: 4,511,409

[45] Date of Patent: Apr. 16, 1985

[54] PROCESS FOR IMPROVING BOTH FATIGUE STRENGTH AND TOUGHNESS OF HIGH-STRENGTH AL ALLOYS

[75] Inventors: Daniel Ferton, Grenoble; Robert Mace, Issoire, both of France

[73] Assignee: Cegedur Societe de Transformation de l'Aluminium Pechiney, Paris, France

[21] Appl. No.: 510,200

[22] Filed: Jul. 1, 1983

[30] Foreign Application Priority Data

Jul. 2, 1982 [FR] France ..... 82 11963

[51] Int. Cl.[3] ..... C22F 1/04

[52] U.S. Cl. ..... 148/2; 148/11.5 A; 148/439

[58] Field of Search ..... 148/11.5 A, 2, 439

[56] References Cited

U.S. PATENT DOCUMENTS 4,305,763 12/1981 Quist et al. ..... 148/11.5 A

*Primary Examiner*—R. Dean

*Attorney, Agent, or Firm*—Oblon, Fisher, Spivak, McClelland & Maier

[57] ABSTRACT

The invention concerns a process for improving the characteristics in respect of fatigue strength and toughness of worked Al alloys in the treated state, by means of a thermo-mechanical treatment which is carried out on the cast and possibly homogenized product.

It comprises the following steps:

(a) casting an initial product along an axis XX' by a known method (b) optional homogenization (c) upsetting in the hot state, preferably by means of a press, along the axis XX', with an upsetting ratio (initial length/final length along axis XX')>1.4

(d) drawing in the hot state in the direction of the axis XX', with a rate of working (initial cross section/final cross section, considered perpendicularly to the axis XX')>1.5

(e) compression in the hot state along an axis perpendicular to the axis XX', with a rate of reduction (initial cross section-final cross section/initial cross section)>15%

(f) rolling, hot extrusion or forging, under the usual conditions, and the usual operations for quenching and tempering with possible relief of stresses by cold working (states T6, T651 or T652 for example).

For equivalent mechanical characteristics, it makes it possible to increase by up to 50% approximately the characteristics in respect of fatigue strength or toughness in the treated state.

7 Claims, 9 Drawing Figures

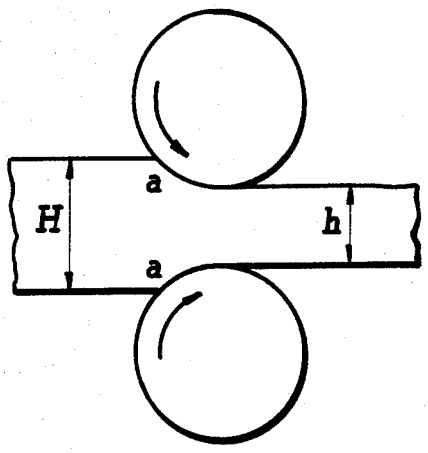
FIG. 2a
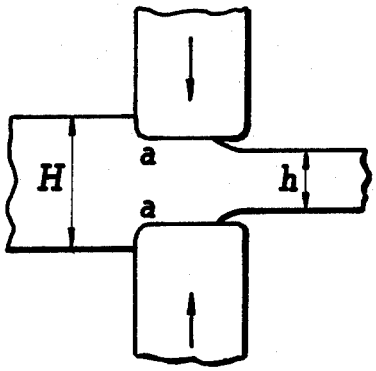
FIG. 2b
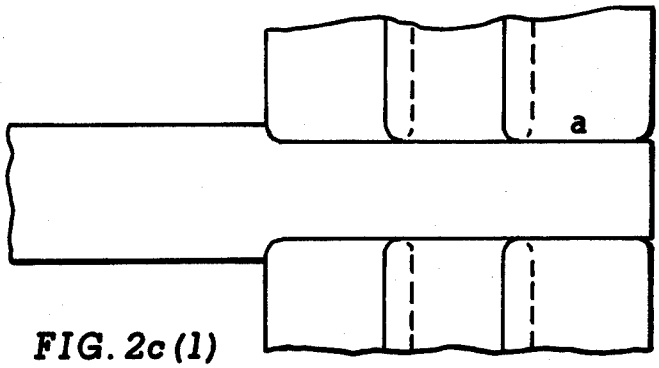
FIG. 2c (1)
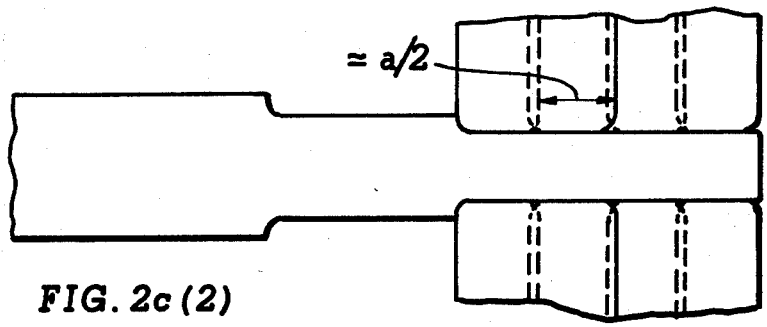
FIG. 2c (2)

A

B

PROCESS FOR IMPROVING BOTH FATIGUE STRENGTH AND TOUGHNESS OF HIGH-STRENGTH AL ALLOYS

The invention concerns a process for improving the fatigue strength and toughness of worked Al alloys in the treated state, by means of a thermo-mechanical treatment which is carried out on the cast and possibly homogenised product.

It is found that the present-day alloys which have the highest levels of performance, being produced by conventional processes, that is to say, for example, vertical semi-continuous casting of a plate, homogenisation, transformation in the hot state (rolling, forging, drawing, etc) and possibly in the cold state, quenching and one or more tempering steps, have characteristics in respect of toughness and fatigue strength which are still inadequate in regard to the uses in which alloys are subjected to severe stresses and in which a high level of reliability is required: this is the case with the aeronautical, space, ballistic and like arts.

The applicants have found a method which, in relation to a given alloy, permits an improvement which may be up to about 50%, in regard to the characteristics of fatigue strength and toughness in the treated state, comprising the following steps:

(a) casting an initial product along an axis XX' by a known method (b) optionally homogenizing (c) upsetting in the hot state, preferably by means of a press, along the axis XX', with an upsetting ratio (initial length/final length along axis XX') $\geqq 1.4$ (d) drawing in the hot state in the direction of the axis XX', with a rate of working (initial cross section/final cross section, considered perpendicularly to the axis XX') $\geqq 1.5$ (e) compressing in the hot state along an axis perpendicular to the axis XX', with a rate of reduction (initial cross section-final cross section/initial cross section) $\geqq 15\%$ (f) rolling, hot extrusion or forging, under the usual conditions, and the usual operations for quenching and tempering with possible relief of stresses by cold working (states T6, T651 or T652 for example).

The homogenisation operation may be interposed between steps (e) and (f).

All the hot operations are performed at the usual temperatures for hot transformation or treatment of the alloy in question.

The hot compression may be carried out using conventional methods such as rolling, press forging or hammer forging, for example.

However, it has been found that the improvement in properties of the alloy is considerable only under certain conditions:

if a denotes the length of contact between the tool and the product, as considered in the long direction, and if H denotes the height or thickness of the product before the deformation operation and h denotes the height or thickness after the deformation operation, the following must apply, in step (e):

$$H/a \leqq 1$$

The rate of reduction $(H-h/h)$ is preferably greater than or equal to 20%.

In the case of forging, and if the deformation operation is carried out in a plurality of passes, it is recommended that the deformation phenomena should be "crossed", that is to say, the deformation effects should be displaced in the long direction by a value in the region of a/2, between each pass, each of the passes being carried out on the condition that $H/a \leqq 1$ and the total deformation being greater than 15% and preferably 20%.

Tests have shown that the products obtained with that method had a novel structure which differs according to the family of alloys in question.

In the families of alloys designated as 2000, using the Aluminium Association designation, the primary precipitates of the finished product enjoy relatively homogenous distribution, being of a solid, compact, non-dendritic form. The precipitates are relatively isolated from each other and do not form more or less linear clusters or accumulations (two particles form part of the same cluster if the spacing thereof is less than or equal to the largest dimension of one of such particles) or do not show the former limits of the joins of solidification grains. The isolated precipitates or the clusters are of a maximum dimension which is less than 100 μm (the dimension of the cluster is equal to the sum of the maximum dimensions of the particles composing it).

In the family of alloys designated as 7000 using the Aluminium Association designation, the primary precipitates are essentially disposed in an intragranular position (and not in the intergranular zones as is the case in the prior art), although the products obtained are substantially non-recrystallised.

The term "substantially intragranular" means that more than 90% of the particles are in the grains of the finished product.

The expression "substantially non-recrystallised" means that the structure of the finished product comprises only 10% at most of its volume in a recrystallised condition.

The Examples and drawings hereinafter illustrate the method according to the invention.

FIG. 2 illustrates the geometrical conditions to be fulfilled in the case of rolling (FIG. 2*a*), forging in one pass (FIG. 2*b*) or in a plurality of passes (FIG. 2*c*), reference (1) representing the first pass and reference (2) representing the second pass.

EXAMPLE 1

An alloy 7010 comprising the following composition (% by weight) was semi-continuously cast, in the form of plates measuring 1030×270 mm:

Zn: 6.20-Mg: 2.40-Cu: 1.6-Zr: 0.10-Fe: 0.03-Si: 0.04, and they were transformed in accordance with a conventional range or series of operations (A) and a range or series according to the invention (B).

The range A essentially comprises homogenisation for 24 hours at a temperature of 470° C., hot rolling (430° C. approximately) to 80 mm thickness, solution annealing for 6 hours at 470° C., quenching in cold water, controlled 2% traction, and T7651 tempering: 24 hours at 118° C.+8 hours at 170° C.

Figure 1:
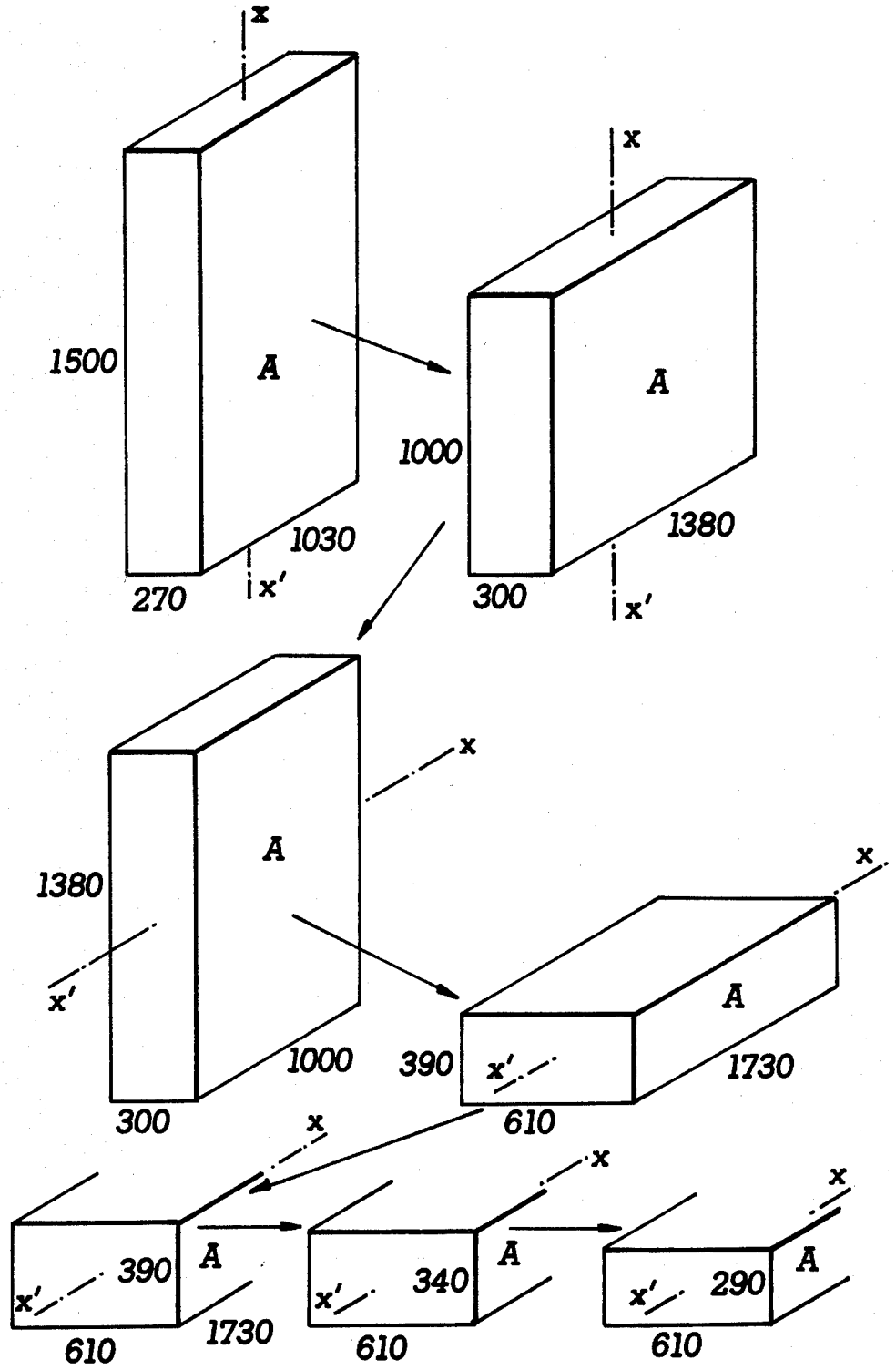
FIG. 1 shows the range of initial deformation of a plate measuring 1030×270 mm in section, for the production of thick plates of from 60 to 80 mm in thickness, the dimensions being given in millimeters.

Range B comprises (see FIG. 1), homogenisation for 24 hours at 470° C., upsetting in the direction of casting, with an upsetting ratio of 1.5, turning the item through a quarter of a turn about a horizontal axis followed by a drawing operation, causing the cross section of the product to go from 1380×300 to 610×390 mm, and then hot compression at a temperature of between 450° and 400° C., using a press (width of the press plates a=500 mm) in two displaced passes, each of the passes being of a value of 50 mm (H−h/h total=25.6%), and finally, hot rolling at 80 mm, solution annealing, quenching in water, 2% traction and T7651 tempering, under the conditions in respect of range A. The results obtained, which are the averages of a number of tests relating to the mechanical characteristics in respect of tensile strength, toughness and fatigue strength are set out in Table I attached.

It is found that, with equivalent tensile strength characteristics, there is a very marked increase in transverse ductility, toughness and fatigue strength.

EXAMPLE 2

Plates of the same dimensions as in Example 1, of alloy 7475 using the Aluminium Association designation, the analysis of which shows the following composition:

Zn: 6%-Mg: 2.10%-Cu: 1.55%-Cr: 0.19%-Fe: 0.06%-Si: 0.05% were cast.

Sheet members of a final thickness of 60 mm were produced using ranges A and B of Example 1, except as regards the solution annealing step which is performed in two stages: 480° C., 3 hours+515° C., 1 hour.

The results obtained (averages of several tests) relating to mechanical characteristics in respect of tensile strength, toughness and fatigue strength are set out in Table II attached.

It is found that, with equivalent tensile strength characteristics, there is a substantial improvement in fatigue strength and toughness.

Figure 3:
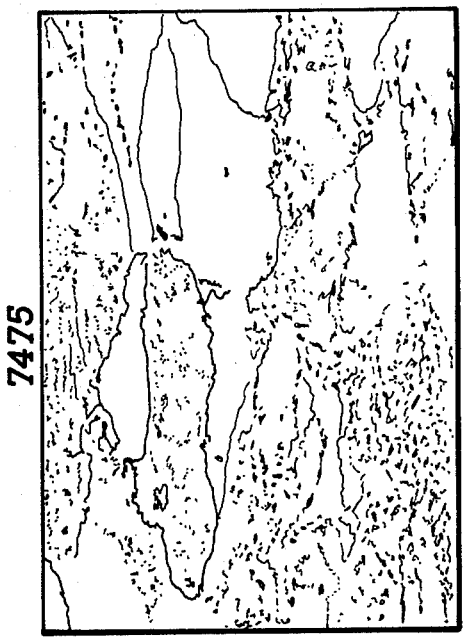
FIGS. 3 and 4 show the microstructures of alloy 7475 treated in accordance with the prior art (A) and in accordance with the invention (B).
Figure 4:
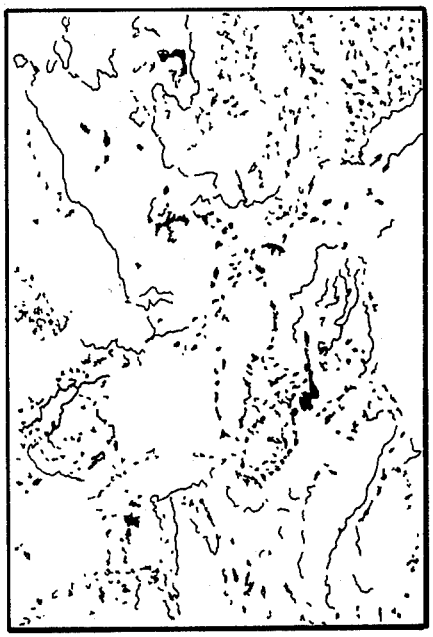

The microstructures corresponding to ranges A and B are set out respectively in FIGS. 3 and 4, with a scale of enlargement of 100.

EXAMPLE 3

Sheet members 60 mm in thickness, of alloy 2214 using the Aluminium Association designation, were produced by means of the ranges of operations A and B in Example 1, except as regards the final treatment which is state T651. Analysis shows the following:

Cu:4.40%-Mg:0.38%-Si:0.85%-Mn:0.66%-Fe:0.11%.

The results obtained (averages of several tests) relating to the mechanical characteristics in respect of tensile strength, toughness and fatigue strength are set out in Table III herewith.

Figure 5:
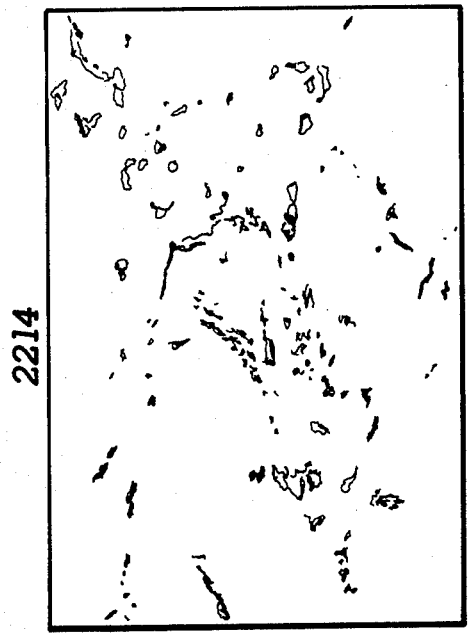
FIGS. 5 and 6 show the microstructures of alloy 2214 treated in accordance with the prior art (A) and in accordance with the invention (B).
Figure 6:
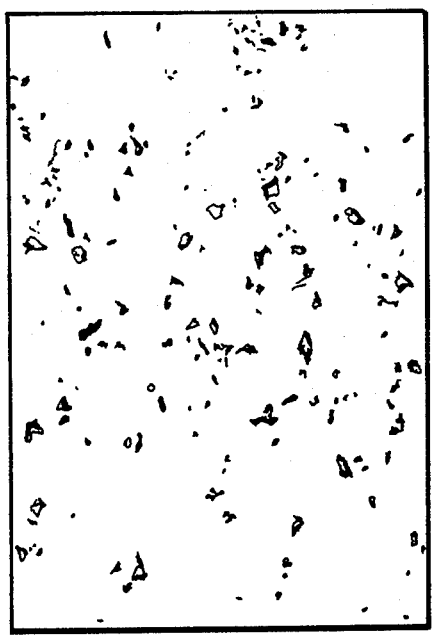

The microstructures of alloy 2214, which are produced in accordance with the prior art (range A) and in accordance with the invention (range B) are respectively shown in FIGS. 5 and 6, on a scale of enlargement of 200. It is found that, relative to the range A, the range of operations B causes the disappearance of the primary precipitates of dendritic form, being of the appearance of chinese script.

EXAMPLE 4

Two castings of alloy 7475, of normal purity and of high purity, were produced, and were subjected to the ranges of operations A and B described in Example 1. Analysis shows the following composition (% by weight):

| | Zn | Cu | Mg | Cr | Si | Fe |
|---|---|---|---|---|---|---|
| casting No 1 | 6.0 | 1.58 | 2.10 | 0.19 | 0.05 | 0.06 |
| casting No 2 | 5.93 | 1.49 | 2.09 | 0.19 | 0.03 | 0.02 |

The results obtained (averages of several tests) relating to the mechanical characteristics in respect of tensile strength, toughness and fatigue are set out in Table IV attached.

TABLE I

| | MECHANICAL TENSILE STRENGTH CHARACTERISTICS | | | | | | | | | Toughness | | | FATIGUE STRENGTH L (*) | |
|---|---|---|---|---|---|---|---|---|---|---|---|---|---|---|
| | L (*) | | | TL (*) | | | TC (*) | | | $K_{IC}$ | MPa $\sqrt{m}$ | | Fatigue lim. | ΔK in MPa $\sqrt{m}$ for a rate of cracking of |
| Range | R0.2 MPa | Rm MPa | A % | R0.2 MPa | Rm MPa | A % | R0.2 MPa | Rm MPa | A % | L-T (**) | T-L (**) | S-L (**) | R = −1, Kt = 0 MPa | 1 × $10^{-4}$ mm/cycle R = 0.1 |
| A | 460 | 510 | 15 | 475 | 520 | 11 | 440 | 515 | 7.5 | 37.6 | 31.1 | 33.1 | ±140 | 9.5 |
| B | 470 | 510 | 15 | 485 | 525 | 11 | 485 | 525 | 11 | 38.6 | 36.5 | 35.2 | ±170 | 11 |
| Gain % | +2.2 | 0 | 0 | +2.1 | +0.95 | 0 | 10.2 | +1.95 | +47 | +2.7 | +17 | +6.3 | ±21.5 | +16 |

(*) L: long direction
TL: long transverse direction
TC: short transverse direction
(**) direction in accordance with standard ASTM E 399-78a

TABLE II

| | MECHANICAL TENSILE STRENGTH CHARACTERISTICS | | | | | | | | |
|---|---|---|---|---|---|---|---|---|---|
| | L (*) | | | T (*) | | | TC (*) | | |
| Range | R0.2 MPa | Rm MPa | A % | R0.2 MPa | Rm MPa | A % | R0.2 MPa | Rm MPa | A % |
| A | 416 | 480 | 17.3 | 416 | 488 | 14.7 | 398 | 484 | 10.5 |
| B | 405 | 461 | 17 | 408 | 473 | 15 | 397 | 480 | 10.6 |
| Gain % | −2.6 | −4.0 | −1.8 | −1.9 | −3.1 | +2.0 | 0 | −0.8 | +1 |

TABLE II-continued

| Range | $K_{IC}$ L-T (**) | Toughness MPa $\sqrt{m}$ T-L (**) | S-L (**) | Fatigue lim. Kt = 0, R = −1 (MPa) | FATIGUE STRENGTH L (*) Number of cycles incipient cracking R = 0.1 Kt = 2.33 σmax = 120 MPa | ΔK in MPa $\sqrt{m}$ for cracking of $1 \times 10^{-4}$ mm/cycle R = 0.1 |
|---|---|---|---|---|---|---|
| A | 55.6 | 40.2 | 38.7 | 158 | 197 000 | 10.5 |
| B | 63 | 52 | 43.9 | 170 | 265 000 | 10 |
| Gain % | +13.3 | +29.4 | +13.5 | +7.4 | +34.5 | −5 |

(*) L: long direction
TL: long transverse direction
TC: short transverse direction
(**) direction in accordance with standard ASTM E399-78a

TABLE III

| Range | MECHANICAL TENSILE STRENGTH CHARACTERISTICS L (*) R0.2 MPa | Rm MPa | A % | TL (*) R0.2 MPa | Rm MPa | A % | TC (*) R0.2 MPa | Rm MPa | A % | Tenacity $K_{IC}$MPa $\sqrt{m}$ L-T (**) | T-L (**) | S-L (**) | FATIGUE L (*) Number of cycles incipient cracking Kt = 2.33 R0.1 σmax: 120 MPa | ΔK in MPa $\sqrt{m}$ for rate of cracking of $1 \times 10^{-4}$ mm/cycle R = 0.1 |
|---|---|---|---|---|---|---|---|---|---|---|---|---|---|---|
| A | 444 | 491 | 12.5 | 429 | 479 | 8.7 | 413 | 467 | 7.1 | 31.9 | 25.8 | 22.1 | 62500 | 10 |
| B | 422 | 454 | 13 | 444 | 501 | 8.7 | 419 | 482 | 9.8 | 39.9 | 38.6 | 32.4 | 91500 | 11 |
| Gain % | −5.0 | −7.5 | +4 | +3.5 | +4.6 | 0 | +1.45 | +3.1 | +28 | +25 | +49 | +47 | +47 | +10 |

(*) L: long direction
TL: long transverse direction
TC: short transverse direction
(**) direction in accordance with standard ASTM E 399-78a

TABLE IV

| Casting No | Range | MECHANICAL CHARACTERISTICS L (*) R0.2 MPa | Rm MPa | A % | TL (*) R0.2 MPa | Rm MPa | A % | TC (*) R0.2 MPa | Rm MPa | A % | Toughness $K_{IC}$ (MPa $\sqrt{m}$) L-T (**) | T-L (**) | S-L (**) | FATIGUE STRENGTH L (*) Number of cycles incipient cracking KT = 2.33 R = 0.1 σmax = 120 MPa |
|---|---|---|---|---|---|---|---|---|---|---|---|---|---|---|
| 1 | A | 393 | 468 | 16.1 | 395 | 471 | 13.5 | 386 | 470 | 9.7 | 52.8 | 36.3 | 33.9 | 67000 |
| | B | 405 | 461 | 17 | 408 | 473 | 15 | 397 | 480 | 10.6 | 63 | 52 | 43.9 | 264000 |
| | Gain % | +3 | −3.5 | +5 | +3 | +0 | +11 | +3 | +2 | +9 | +19 | +43 | +29 | +294 |
| 2 | A | 390 | 464 | 16 | 395 | 474 | 13.4 | 380 | 470 | 11.8 | 76.9 | 59.9 | 53.5 | 91000 |
| | B | 407 | 473 | 16.2 | 405 | 474 | 14 | 396 | 484 | 14.4 | 70.5 | 68.7 | 51.9 | 9 550000 |
| | Gain % | +4 | +4 | +0.5 | +2.5 | 0 | +4.5 | +4 | +3 | +12 | −8 | +15 | −3 | +1040 |

(*) L: long direction
TL: long transverse direction
TC: short transverse direction
(**) direction in accordance with standard ASTM E 399-78a

We claim:

1. A method of improving both fatigue strength and toughness of high-strength Al alloys, comprising casting the high strength Al alloy product along an axis XX'; hot upsetting along the axis XX', with an upsetting ratio (initial length/final length along axis XX') of >1.4; hot drawing along the axis XX', with a rate of working (initial cross section/final cross section) considered perpendicularly to the axis XX' of >1.5; hot compressing along an axis perpendicular to the axis XX', with a rate of reduction (initial cross section-final cross section/initial cross section) of >15%; and hot deforming in the direction of the XX' axis, wherein the ratio of the thickness of a product (H) to the length of the contact of the product with a tool (a) as measured in the long direction, is less than or equal to 1.

2. The method according to claim 1, wherein in the hot compression step, using a press or a hammer, in a plurality of passes, the deformations between each pass are displaced by a value which is about a/2, in the long direction.

3. The method according to claim 1, wherein the rate of reduction in the hot compression step is greater than 20%.

4. The method according to claim 1, wherein homogenisation of the product is effected either immediately before the hot upsetting step or immediately after the hot compression step and before the hot deformation step.

5. An Al alloy of the 2000 series prepared according to the method of claim 1 which, in the treated state, contains primary precipitates of compact, solid and non-dendritic form.

6. The alloy according to claim 5 wherein the largest dimension of the particles or clusters is less than 100 μm.

7. An Al alloy of the 7000 series prepared according to the method of claim 1 which, in the treated and substantially non-recrystallised state, has a substantially intragranular position of the primary precipitates.

* * * * *